US005605121A

United States Patent [19]

Scheidt et al.

[11] Patent Number: 5,605,121

[45] Date of Patent: Feb. 25, 1997

[54] DEVICE FOR ADJUSTING VALVE TIMING IN AN INTERNAL COMBUSTION ENGINE

[75] Inventors: Martin Scheidt, Adelsdorf; Andreas Strauss, Herzogenaurach; Eduard Golovatai-Schmidt, Nuremberg, all of Germany

[73] Assignee: Ina Walzlager Schaeffler KG, Germany

[21] Appl. No.: 570,132

[22] Filed: Dec. 11, 1995

[30] Foreign Application Priority Data

Feb. 27, 1995 [DE] Germany ..... 195 06 751.7

[51] Int. Cl.[6] ..... F01L 1/34; F01L 1/04

[52] U.S. Cl. ..... 123/90.17; 464/2; 123/90.31

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,138,985 | 8/1992 | Szodfridt et al. | 123/90.17 |
| 5,205,248 | 4/1993 | Hara et al. | 123/90.17 |
| 5,215,046 | 6/1993 | Takenaka et al. | 123/90.17 |
| 5,377,639 | 1/1995 | Nakadouzono et al. | 123/90.17 |
| 5,474,038 | 12/1995 | Golovatai-Schmidt et al. | 123/90.17 |

FOREIGN PATENT DOCUMENTS

| | | |
|---|---|---|
| 4218082 | 12/1993 | Germany . |
| 4321003 | 1/1995 | Germany . |

*Primary Examiner*—Weilun Lo
*Attorney, Agent, or Firm*—Bierman and Muserlian

[57] ABSTRACT

A device (1) for adjusting valve timing in an internal combustion engine, disposed within a control gear of at least one camshaft on a drive pinion (3) which is in driving relationship with this camshaft, said device (1) comprising an adjusting piston (2) which is axially displaceable by a hydraulic medium and whose first and second end faces (11,12) delimit a first and a second pressure chambers (13,14) while a peripheral surface (15) of the adjusting piston (2) bears sealingly against a housing (16) which delimits the first and the second pressure chambers (13,14) radially outwards, the adjusting piston (2) comprising two oppositely oriented helical gear sections, (6,7) and first (6) of said two helical gear sections cooperates with a corresponding gear (5) of a driving element (4) connected to the drive pinion (3), while second (7) of said two helical gear sections cooperates with a gear (8) of a driven element (9) connected to the camshaft, a stop element (18,19) or an end portion of the housing being arranged in an axially outer portion of each of the two pressure chamberss (13,14) to define a position of maximum displacement of the camshaft, characterized in that the stop element (18) or the end portion of the housing of the first pressure chamber (13), towards which the adjusting piston (2) is displaced on starting of the engine, and/or the first end face (11) of the adjusting piston (2) facing this pressure chamber (13) comprises a hydraulic and/or pneumatic end position damping means for the adjusting piston (2).

11 Claims, 3 Drawing Sheets

DEVICE FOR ADJUSTING VALVE TIMING IN AN INTERNAL COMBUSTION ENGINE

STATE OF THE ART

A device for adjusting valve timing in an internal combustion engine, disposed within a control gear of at least one camshaft on a drive pinion which is in driving relationship with this camshaft, said device comprising an adjusting piston which is axially displaceable by a hydraulic medium and whose first and second end faces delimit a first and a second pressure chamber while a peripheral surface of the adjusting piston bears sealingly against a housing which delimits the first and the second pressure chamber radially outwards, the adjusting piston comprising two oppositely oriented helical gear sections, and first of said two helical gear sections cooperates with a corresponding gear of a driving element connected to the drive pinion, while second of said two helical gear sections cooperates with a gear of a driven element connected to the camshaft, a stop element or an end portion of the housing being arranged in an axially outer portion of each of the two pressure chambers to define a position of maximum displacement of the camshaft is known from DE-PS 29 09 803. Devices of this type have the disadvantage that on starting of the engine, the adjusting piston moves very rapidly into a position of maximum displacement in which its repeated abutment causes a considerable amount of noise. This is due to the fact that when the engine is turned off, the hydraulic medium contained in the device gradually escapes therefrom so that the adjusting piston is no longer sufficiently supported hydraulically although a certain residual amount of hydraulic medium is still present. Due to the cyclic irregularities of the camshaft, the displacement of the adjusting piston, which no longer has an adequate hydraulic support, into an end position on re-starting of the engine is accompanied by the already mentioned noise emission. This state prevails during a period of time between the ignition of the engine and the filling of the pressure chambers, that is to say, for a few seconds after the engine has been started.

Although some solutions are known in the technical field for reducing or eliminating noise caused by a tooth profile play between the meshing gears of the adjusting device, no practicable solutions for eliminating "start rattling" by simple means were known at the time of the present application.

OBJECTS OF THE INVENTION

It is an object of the invention to provide a device of the pre-cited type in which the disadvantages described above are overcome and the mentioned start rattling is avoided by simple means, i.e. by minor structural measures.

These and other objects and advantages of the invention will become obvious from the following detailed description.

THE INVENTION

The novel device of the invention for adjusting valve timing in an internal combustion engine, disposed within a control gear of at least one camshaft on a drive pinion (3) which is in driving relationship with this camshaft, said device (1) comprising an adjusting piston (2) which is axially displaceable by a hydraulic medium and whose first and second end faces (11,12) delimit a first and a second pressure chambers (13, 14) while a peripheral surface (15) of the adjusting piston (2) bears sealingly against a housing (16) which delimits the first and the second pressure chambers (13, 14) radially outwards, the adjusting piston (2) comprising two oppositely oriented helical gear sections, (6, 7) and first (6) of said two helical gear sections cooperates with a corresponding gear (5) of a driving element (4) connected to the drive pinion (3), while second (7) of said two helical gear sections cooperates with a gear (8) of a driven element (9) connected to the camshaft, a stop element (18,19) or an end portion of the housing being arranged in an axially outer portion of each of the two pressure chamberss (13,14) to define a position of maximum displacement of the camshaft, is characterized in that the stop element (18) or the end portion of the housing of the first pressure chamber (13), towards which the adjusting piston (2) is displaced on starting of the engine, and/or the first end face (11) of the adjusting piston (2) facing this pressure chamber (13) comprises a hydraulic and/or pneumatic end position damping means for the adjusting piston (2).

The object of the invention is achieved in that the stop element or the end portion of the housing of the first pressure chamber, towards which the adjusting piston is displaced on starting of the engine, and/or the first end face of the adjusting piston facing this pressure chamber comprises a hydraulic and/or pneumatic end position damping means for the adjusting piston. In a first embodiment of the invention, this end position damping means is a squeezing gap. This hydraulic medium squeezing gap effectively reduces the kinetic energy of the adjusting piston shortly before the adjusting piston reaches an end position. Due to the fact that the adjusting piston has to perform additional work to displace hydraulic medium immediately before reaching its end position, a hard abutment of the adjusting piston against its stop element is effectively avoided. Thus, the initially described detrimental rattling noises on re-starting of the engine are eliminated.

To obtain a finer regulation of the end position damping, a ring provided in another embodiment of the invention, or the stop element, comprises recesses through which a controlled outflow of the enclosed hydraulic medium is assured. In this embodiment, therefore, the residual hydraulic medium contained as a rule in the device is put to use.

In another embodiment of the invention, a compression of the pneumatic medium (air) which collects in the device when this has been shut off is utilized to effect end position damping. For this, at least one elastic element is arranged facing the first pressure chamber on the stop element or on the adjusting piston. This elastic element seals the compression space radially in one direction so that shortly before the position of maximum displacement of the adjusting piston is reached, an air cushion is formed between the adjusting piston and the stop element. The elastic element is configured, for example, as a sealing ring but its geometric shape can be freely chosen as long as it is capable of sealing the compression space. An air cushion thickness of approximately 1 mm is sufficient, but it must be guaranteed that the stop element is firmly fixed on the housing so that a possible suction or sticking thereof on the opposite surface due to the partial vacuum formed in the pressure chamber is avoided and the end position damping is guaranteed for the lifetime of the entire equipment.

Advantageously, the device as a whole is configured so that a pressure of approximately 0.5 to 1 bar in the second pressure chamber eliminates the air cushion between the two components and the pressure piston abuts "firmly" against the stop element. This structural design is necessary also to adapt the device with a view to measures relating to its electronic control. It is also conceivable to make the stop element integrally with the housing or to have it emanate directly from the housing. In this case, it would not be necessary to manufacture separately and fix the stop element in the pressure chamber into which the adjusting piston advances on re-starting of the engine.

What is important for the invention is that the entire end position damping is conceived so that the reaction of the adjusting device in its operating region is not prejudiced by the damping device. A slowing-down of the reaction of the adjusting device in this region due to damping is acceptable because the hydraulic support obtained on a refilling of the device assures a rapid "crossing" of this region and, on the other hand, this region near the end position does not have to be used anyway, but is of interest only for special conditions of the device such as during electronic balancing and the like. If necessary, it is also possible to enlarge the total angle of adjustment of the device so that operation can then be effected in a range not included in this enlarged range.

BRIEF DESCRIPTION OF THE DRAWINGS

FIGS. 1 to 3 show a device (1), known in itself, for adjusting valve timing in an internal combustion engine. As can be seen in the FIGS., the device (1) is equipped with a hydraulic end position damping means for an adjusting piston (2). The-order of the FIGS. 1 to 3 corresponds to the progressive movement of the pressure piston (2) on re-starting of the internal combustion engine.

Figure 1:
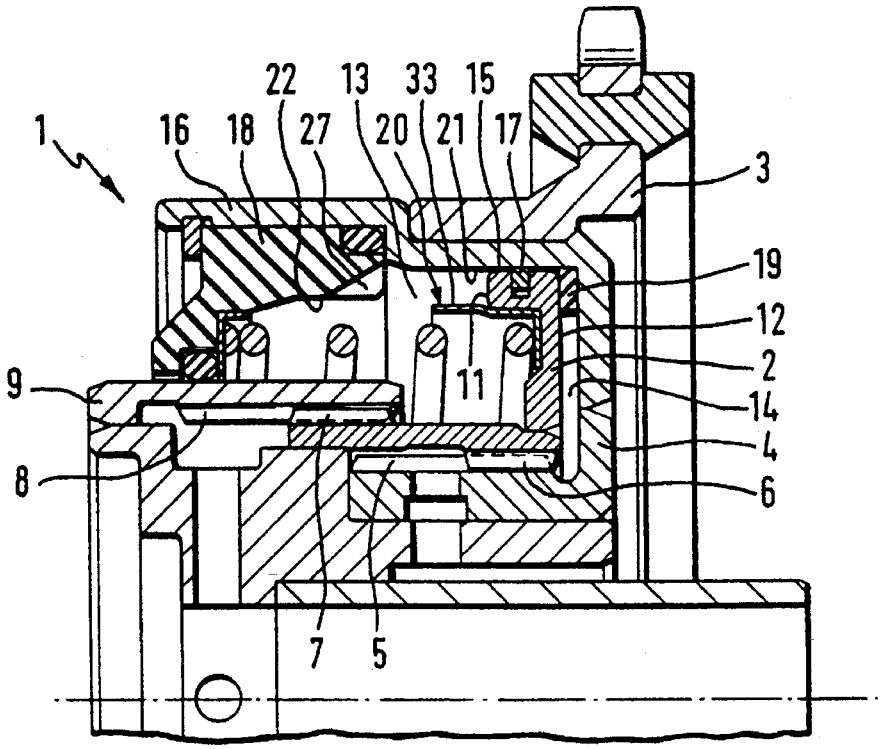
FIGS. 1 to 3 show a device of the invention having a hydraulic end position damping.

The device (1) comprises a concentric drive pinion (3) which is in driving relationship with a camshaft via a traction means, not shown. The drive pinion (3) acts on a driving element (4) having an external gearing (5) which, in this case, is a helical gearing. An internal gearing (6) of the adjusting piston (2) meshes with this external gearing (5) and the adjusting piston (2) further comprises an external gearing (7) which meshes with a mating internal gearing (8) of a driven element (9).

Opposing end faces (11) and (12) of the adjusting piston (2) delimit pressure chambers (13) and (14) into which a hydraulic medium for the axial displacement of the adjusting piston (2) can be fed in a known manner. A radially outer peripheral surface (15) of the adjusting piston (2) bears against a housing (16) which likewise defines the pressure chambers (13,14). In the present embodiment, the housing (16) is made integrally with the driving element (4). To prevent an undesired flow of hydraulic medium between the two pressure chambers (13,14), a sealing ring (17) is arranged on the peripheral surface (15) of the adjusting piston (2).

In an axially outer portion of each of the pressure chambers (13,14) of this embodiment, there is arranged a stop element (18,19) which defines the maximum adjusting stroke of the adjusting piston (2). The mode of operation of the adjusting device as a whole will not be discussed here as it is sufficiently well-known in the technical field.

Figure 2:
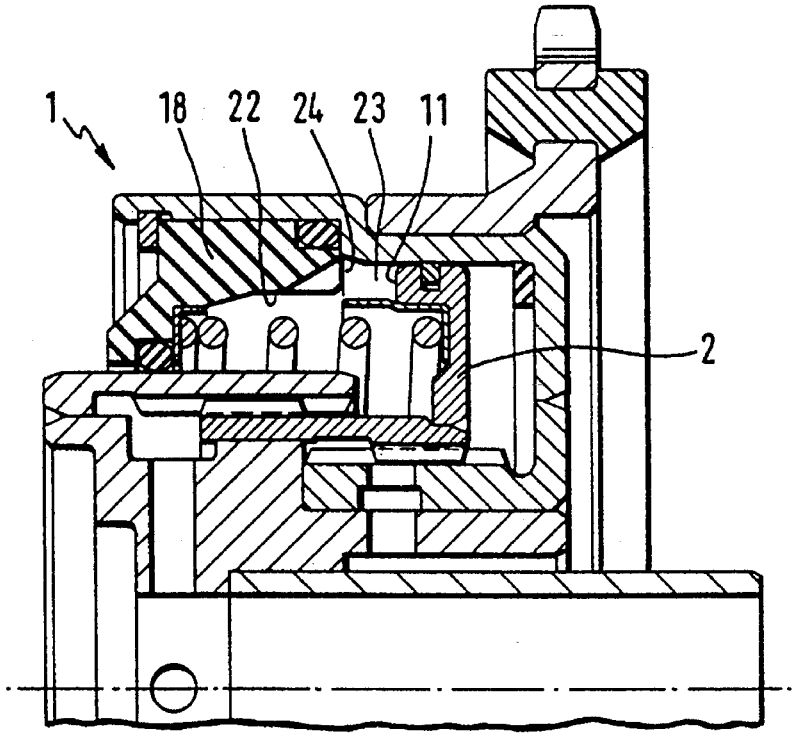
Figure 3:
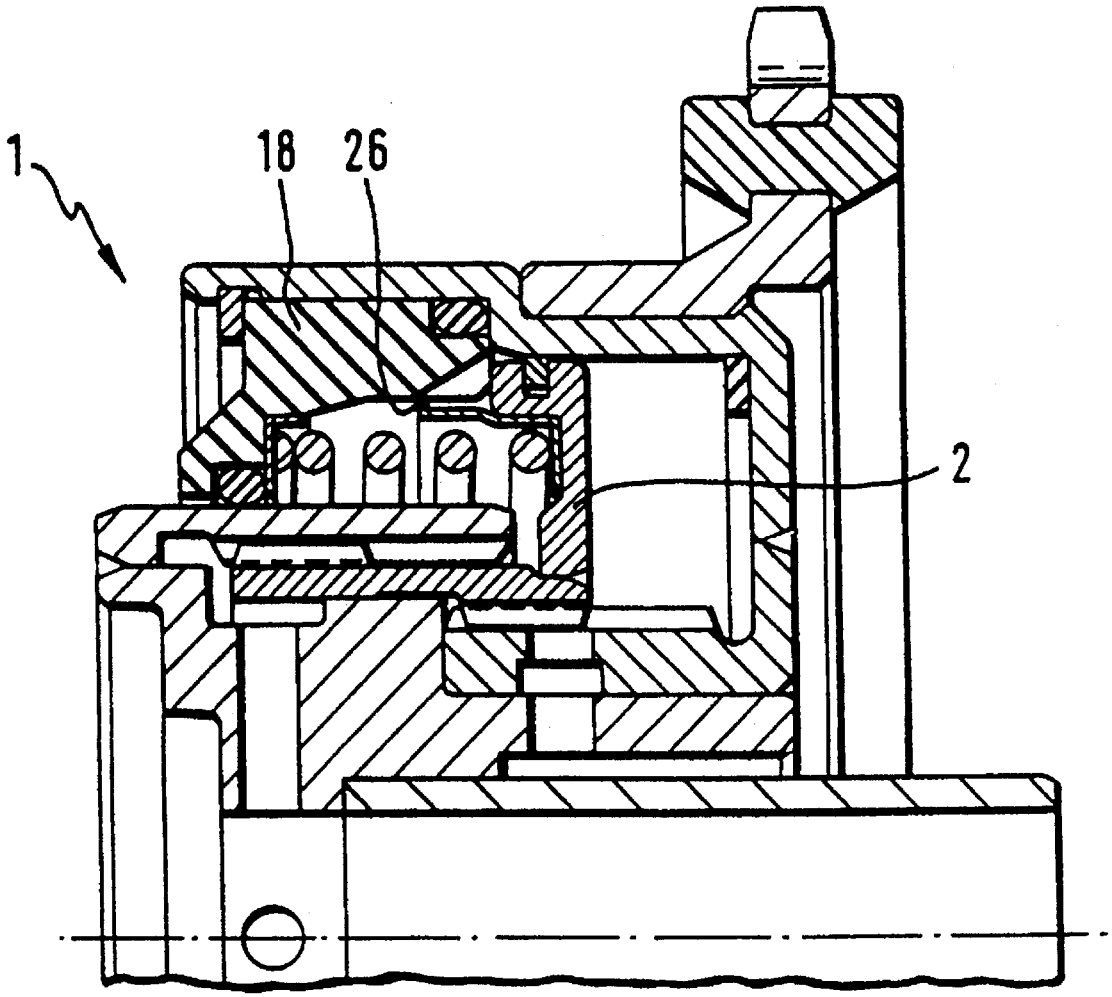

As can be seen in FIGS. 1 to 3, a hydraulic end position damping for the adjusting piston (2) of the device (1) can be arranged on the stop element (18). Since, as already discussed above, on starting of the internal combustion engine, the adjusting piston (2) moves at a high speed towards an end position (here, the stop element (18)), an undesired rattling noise is produced when the adjusting piston (2) abuts against the stop element (18). This noise is eliminated by the invention. This is achieved in a first embodiment by the fact that immediately before the adjusting piston (2) reaches its position of maximum displacement, after having traversed the pressure chamber (13), an end position damping in the form of a squeezing gap (26) (see also FIG. 3) for the remaining hydraulic medium in the device (1) is formed with the help of a concentric ring (20) which is arranged on the end face (11) of the adjusting piston (2) at a distance from an inner peripheral surface (21) of the housing (16). The stop element (18), which is arranged facing this ring (20) in the pressure chamber (13), bears by some portions against the inner peripheral surface (21) of the housing (16). A bore (22) of the stop element (18) has, at least at its end nearer the adjusting piston (2), a diameter which is slightly larger than the outer diameter of the concentric ring (20) of the adjusting piston (2). FIG. 1 shows one of the possible adjusting positions of the adjusting piston (2) after the engine has been shut off.

On re-starting of the engine, as can be seen in FIG. 2, the adjusting piston (2) moves rapidly towards the stop element (18). The ring (20), which, before this, is axially spaced from the stop element (18), now intersects an end face (24) of the stop element (18). The residual amount of hydraulic medium present in the device at this stage and which, on re-starting of the engine flows into the pressure chambers (13,14) and into various ducts, not shown, now collects in an annular space (23) which is defined by the end faces (24) and (11) of the stop element (18) and the adjusting piston (2), respectively, facing each other. This annular space (23) is defined at the same time radially by the ring (20) and the housing (16). On further axial displacement of the adjusting piston (2) towards the stop element (18) caused by the cyclic irregularities of the camshaft, not shown, a squeezing gap (26) is formed between the bore (22) of the stop element (18) and the concentric ring (20) (see FIG. 3). Thus a part of the kinetic energy of the adjusting piston (2) is consumed by the required compression work so that a gentle abutment of the adjusting piston (2) against the stop element (18) is obtained. As already mentioned above, the stop element (18) may be made integrally on a portion of the housing.

To obtain a controlled outflow of the hydraulic medium collected in the annular space (23), it is possible, if necessary, to provide at least one recess (27) in the edge region between the end face (24) and the bore (22) of the stop element (18) (see FIG. 1) and/or recess (27) in the concentric ring (20).

Figure 4:
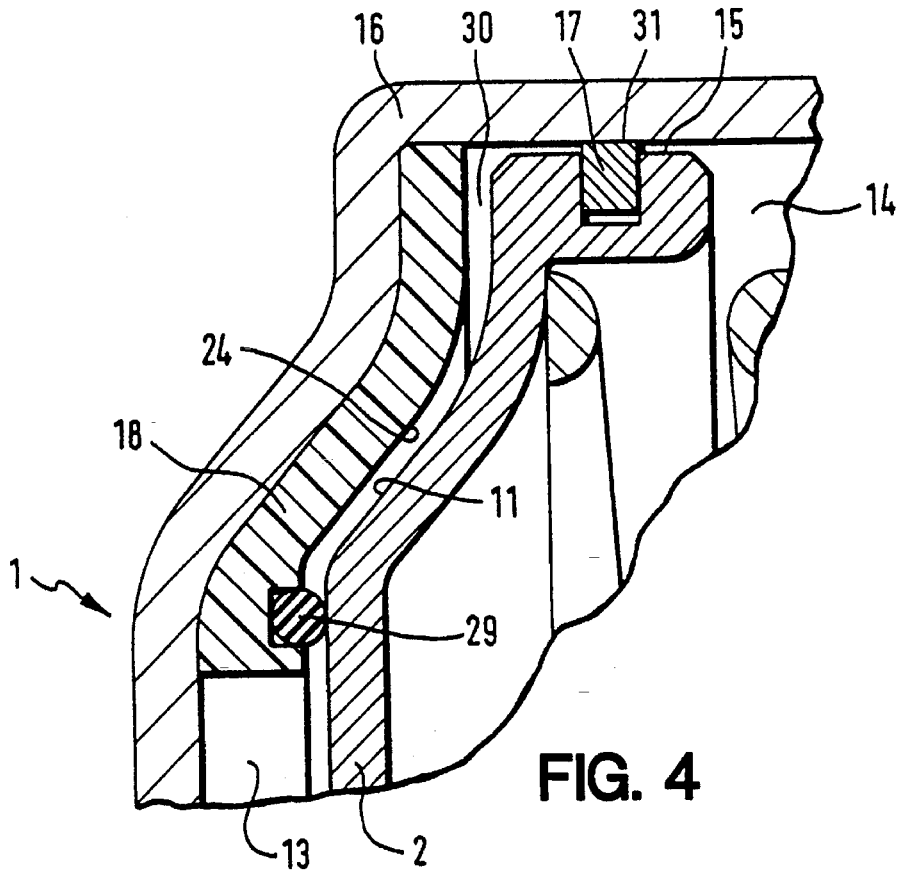
FIGS. 4 and 5 illustrate a device of the invention having a pneumatic end position damping.

An alternative to the embodiment of FIGS. 1 to 3 is shown in FIG. 4. In the pressure chamber (13), towards which the adjusting piston (2) moves on re-starting of the engine, there is arranged on the stop element (18), at least one elastic element (29) such as a round ring. This element (29) projects slightly into the pressure chamber (13) and seals the developing compression space (30) in one radial direction. An important feature of the embodiment of FIG. 4 is that the end faces (24,11) of the stop element (18) and the adjusting piston (2) facing each other are approximately congruent. Thus, when the adjusting piston (2) approaches the end face (24) of the stop element (18), an air cushion or compression space (30) is formed between the two elements (2) and (18). This air cushion (30) serves to damp the axial movement of the adjusting piston (2) towards its end position. Leakage from the compression space (30) is prevented to the largest possible extent by a sealing ring (17) arranged on the peripheral surface (15) of the adjusting piston (2).

Figure 5:
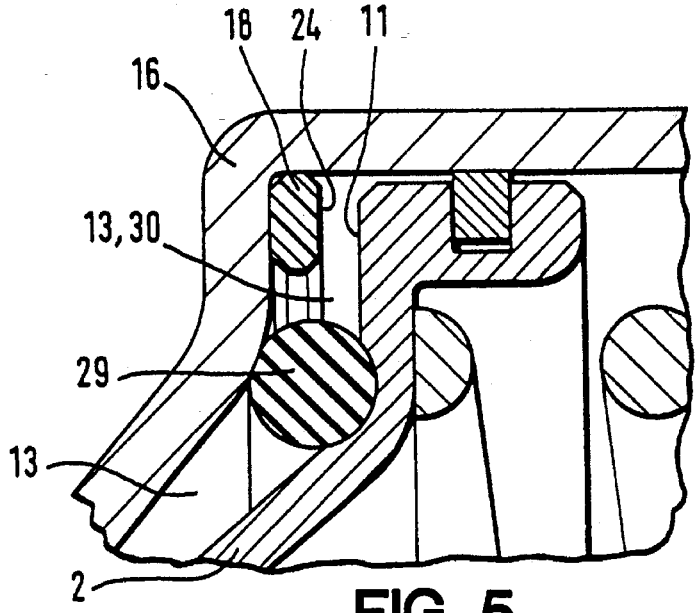

An alternative to the above embodiment is shown in FIG. 5. The stop element (18) of this embodiment has only a short radial extent so that the end faces (24,11) of the stop element (18) and the adjusting piston (2) no longer have to be complementary. The elastic element (29) is fixed on the adjusting piston (2), for example, by gluing. Thus, there remains a sufficiently large pressure chamber (13) for hydraulic medium "under" the element (29).

Various other modifications of the device of the invention may be made without departing from the spirit or scope thereof and it is to be understood that the invention is intended to be limited only as defined in the appended claims.

What we claim is:

1. A device (1) for adjusting valve timing in an internal combustion engine, disposed within a control gear of at least one camshaft on a drive pinion (3) which is in driving relationship with this camshaft, said device (1) comprising an adjusting piston (2) which is axially displaceable by a hydraulic medium and whose first and second end faces (11, 12) delimit a first and a second pressure chambers (13,14) while a peripheral surface (15) of the adjusting piston (2) bears sealingly against a housing (16) which delimits the first and the second pressure chambers (13, 14) radially outwards, the adjusting piston (2) comprising two oppositely oriented helical gear sections, (6,7) and a first (6) of said two helical gear sections cooperates with a corresponding gear (5) of a driving element (4) connected to the drive pinion (3), while a second (7) of said two helical gear sections cooperates with a gear (8) of a driven element (9) connected to the camshaft, a stop element (18,19) or an end portion of the housing being arranged in an axially outer portion of each of the two pressure chambers (13,14) to define a position of maximum displacement of the camshaft, characterized in that the stop element (18) or the end portion of the housing of the first pressure chamber (13), towards which the adjusting piston (2) is displaced on starting of the engine, and/or the first end face (11) of the adjusting piston (2) facing this pressure chamber (13) comprises a hydraulic and/or pneumatic end position damping means for the adjusting piston (2).

2. A device of claim 1 wherein the end position damping means is a hydraulic medium squeezing gap (26) which is formed shortly before the position of maximum displacement is reached.

3. A device of claim 1 wherein the end position damping means is an air cushion (30) which is formed shortly before the position of maximum displacement is reached.

4. A device of claim 2 wherein a concentric ring (20) is fixed on the first end face (11) of the adjusting piston (2) at a distance from an inner peripheral surface (21) of the housing (16), the stop element (18) which bears by some portions against the inner peripheral surface (21) of the housing (16) comprises a bore (22) whose diameter is equal to or minimally larger than an outer diameter (33) of the concentric ring (20) which is axially spaced from the stop element (18) in an undisplaced state of the adjusting piston (2), so that on displacement of the adjusting piston (2) towards the stop element (18), there is formed between the outer diameter (33) of the ring (20) and the bore (22) of the stop element (18), the squeezing gap (26) for hydraulic medium collected in an annular space (23) which is defined axially by opposite end faces (24 and 11) of the stop element (18) and the adjusting piston (2), and radially by the concentric ring (20) and, at least indirectly, by the housing (16).

5. A device of claim 3 wherein a concentric ring (20) is fixed on the first end face (11) of the adjusting piston (2) at a distance from an inner peripheral surface (21) of the housing (16), the stop element (18) which bears by some portions against the inner peripheral surface (21) of the housing (16) comprises a bore (22) whose diameter is equal to or minimally larger than an outer diameter (33) of the concentric ring (20) which is axially spaced from the stop element (18) in an undisplaced state of the adjusting piston (2), so that on displacement of the adjusting piston (2) towards the stop element (18), there is formed between the outer diameter (33) of the ring (20) and the bore (22) of the stop element (18), the squeezing gap (26) for hydraulic medium collected in an annular space (23) which is defined axially by opposite end faces (24 and 11) of the stop element (18) and the adjusting piston (2), and radially by the concentric ring (20) and, at least indirectly, by the housing (16).

6. A device of claim 4 wherein an edge region of the stop element (18) between the end face (24) and the bore (22) comprises at least one recess (27).

7. A device of claim 3 wherein at least one elastic sealing element (29) projecting slightly into the first pressure chamber (13) is arranged facing this pressure chamber (13) on the stop element (18) or on the adjusting piston (2), and the air cushion (30) which is delimited radially inwardly by the elastic element (29) extends between opposite end faces (24, 11) of the stop element (18) and the adjusting piston (2).

8. A device of claim 7 wherein at least one sealing ring (17) is arranged on the peripheral surface (15) of the adjusting piston (2) to cooperate with the housing (16).

9. A device of claim 7 wherein the air cushion (30) has a thickness of approximately 1 mm.

10. A device of claim 7 wherein the elastic element (29) is configured as a sealing ring.

11. A device of claim 7 wherein a pressure medium pressure of approximately 0.5 to 1 bar in the second pressure chamber (14) eliminates the air cushion (30) between the adjusting piston (2) and the stop element (18) so that the adjusting piston (2) bears against the stop element (18).

* * * * *